US011364167B2

(12) United States Patent
Auzelyte

(10) Patent No.: US 11,364,167 B2
(45) Date of Patent: Jun. 21, 2022

(54) NEONATAL CARE SYSTEM WITH SLING SLEEP DEVICE

(71) Applicant: GE Precision Healthcare LLC, Wauwatosa, WI (US)

(72) Inventor: Ramune Auzelyte, Wauwatosa, WI (US)

(73) Assignee: GE Precision Healthcare LLC, Wauwatosa, WI (US)

( * ) Notice: Subject to any disclaimer, the term of this patent is extended or adjusted under 35 U.S.C. 154(b) by 114 days.

(21) Appl. No.: 16/273,607

(22) Filed: Feb. 12, 2019

(65) Prior Publication Data

US 2020/0253802 A1 Aug. 13, 2020

(51) Int. Cl.
*A61G 11/00* (2006.01)

(52) U.S. Cl.
CPC ..... *A61G 11/002* (2013.01); *A61G 11/008* (2013.01); *A61G 11/009* (2013.01)

(58) Field of Classification Search
CPC .... A61G 11/008; A61G 11/002; A61G 11/009
USPC ..... 600/21–22
See application file for complete search history.

(56) References Cited

U.S. PATENT DOCUMENTS 2,260,584 A * 10/1941 Schuck ..... A47D 7/04 5/94
3,837,019 A * 9/1974 Hoff ..... A47C 17/64 5/93.1
4,146,885 A * 3/1979 Lawson, Jr. ..... G08B 21/22 600/534
4,885,918 A * 12/1989 Vaccaro ..... A61G 11/00 600/22
5,216,770 A * 6/1993 Holt ..... A61G 13/121 128/202.18
5,244,452 A * 9/1993 Vaccaro ..... A61G 11/008 5/603
5,274,863 A * 1/1994 Fountain ..... A47D 9/00 5/120
5,664,273 A 9/1997 Obriot
5,857,232 A * 1/1999 Mahdavi ..... A47C 21/046 5/655
6,071,228 A * 6/2000 Speraw ..... A61G 11/00 600/22
6,464,715 B1 * 10/2002 Gysens ..... A61N 5/0621 200/61
6,880,188 B1 * 4/2005 Schmidt ..... A61B 6/4283 177/144
7,614,098 B1 * 11/2009 Quarry ..... A47C 7/407 24/13

(Continued)

FOREIGN PATENT DOCUMENTS

CN 103859873 B 6/2014
WO 1985003209 A1 8/1985

*Primary Examiner* — Sunita Reddy
(74) *Attorney, Agent, or Firm* — Andrus Intellectual Property Law, LLP

(57) ABSTRACT

A neonatal care system includes a base, a bassinet platform supported on the base, and a neonatal sleep device. The neonatal sleep device includes a frame structure connected to and extending upward from the bassinet platform, wherein the sling is suspended above the bassinet platform and configured to support a neonate. The neonatal care system further includes a heater configured to heat an environment surrounding the neonate supported in the sling.

17 Claims, 9 Drawing Sheets

(56) References Cited

U.S. PATENT DOCUMENTS 7,752,691 B2 7/2010 Bensoussan
7,761,942 B2 7/2010 Benzo et al.
7,780,236 B2 8/2010 Bergkvist
7,827,631 B2 11/2010 Holman
7,886,379 B2 2/2011 Benzo et al.
8,001,630 B2 8/2011 Burkholder et al.
8,745,793 B2 6/2014 Bensoussan
8,769,746 B2 7/2014 Abadi
9,943,175 B1 * 4/2018 Spencer ..... A47D 9/00
2002/0100116 A1 * 8/2002 Richards ..... A47D 9/02 5/108
2004/0236174 A1 * 11/2004 Boone ..... A61B 5/7435 600/21
2005/0034232 A1 * 2/2005 Martin ..... A47D 7/02 5/95
2006/0138826 A1 * 6/2006 Caton ..... A47D 13/02 297/256.16
2006/0225204 A1 * 10/2006 Bretschger ..... A47D 7/04 5/93.1
2007/0089236 A1 * 4/2007 Bailey-VanKuren ..... F16F 15/0232 5/1
2007/0289060 A1 * 12/2007 Berkey ..... A47D 7/002 5/99.1
2008/0060128 A1 * 3/2008 Forshpan ..... A47D 13/107 5/98.3
2008/0271243 A1 * 11/2008 Burkholder ..... A47D 9/00 5/93.2
2009/0113625 A1 * 5/2009 Hutchinson ..... A47D 7/04 5/93.1
2009/0235461 A1 * 9/2009 Straub ..... A47D 15/008 5/655
2009/0256408 A1 * 10/2009 Bergkvisit ..... A47D 13/10 297/354.12
2010/0010599 A1 * 1/2010 Chen ..... A61F 7/02 607/112
2010/0229300 A1 * 9/2010 Eirich ..... A47D 9/00 5/93.1
2010/0229301 A1 * 9/2010 Arnold, IV ..... A47D 9/02 5/93.2
2011/0113555 A1 * 5/2011 Smith ..... A61G 11/00 5/601
2011/0148155 A1 * 6/2011 Chapman ..... A47D 9/02 297/16.1
2011/0148159 A1 * 6/2011 Barron ..... A47D 5/00 297/219.12
2012/0096646 A1 * 4/2012 Barron ..... A47D 1/10 5/655
2012/0137429 A1 * 6/2012 Aaron ..... A47D 9/02 5/93.1
2013/0096365 A1 * 4/2013 Andersson ..... A61F 5/37 600/22
2013/0204074 A1 * 8/2013 Belval ..... A61G 1/042 600/22
2013/0267765 A1 * 10/2013 Rapoport ..... A61G 11/005 600/22
2014/0031906 A1 * 1/2014 Brezinski ..... A61N 5/06 607/90
2015/0015036 A1 * 1/2015 Soriano ..... A47D 13/102 297/217.4
2015/0126804 A1 * 5/2015 Rapoport ..... A61G 10/00 600/22
2015/0209598 A1 * 7/2015 Bhosale ..... A61N 5/0621 607/90
2015/0231012 A1 * 8/2015 Rapoport ..... A61G 11/006 600/22
2016/0073889 A1 * 3/2016 Belsinger, Jr. ..... A61G 1/01 600/549
2016/0074260 A1 * 3/2016 Belsinger, Jr. ..... A47D 13/02 600/509
2016/0081863 A1 * 3/2016 Belsinger, Jr. ..... A61F 5/3776 128/872
2016/0165961 A1 * 6/2016 Karp ..... A41B 13/065 2/69.5
2016/0192787 A1 * 7/2016 Perrin ..... A47D 1/10 297/16.1
2016/0199241 A1 * 7/2016 Rapoport ..... G10K 11/175 600/22
2016/0270993 A1 * 9/2016 Wilden ..... A61G 11/006
2017/0188879 A1 * 7/2017 Rapoport ..... A61G 11/00
2017/0196373 A1 * 7/2017 Sclare ..... A47D 5/00
2017/0360638 A1 * 12/2017 Moletto ..... A61G 11/002
2018/0289573 A1 * 10/2018 Degrazia ..... A47D 13/08
2019/0374044 A1 * 12/2019 Acevedo ..... A47D 11/005
2019/0380901 A1 * 12/2019 Breegi ..... A61G 11/00

* cited by examiner

NEONATAL CARE SYSTEM WITH SLING SLEEP DEVICE

BACKGROUND

The present disclosure generally relates to neonatal care systems, and more specifically to neonatal care systems incorporating a sleep device having a sling and frame structure for supporting a neonate.

Some neonates and especially some significantly prematurely born infants are not physiologically well enough developed to be able to survive without special medical attention. A frequently used medical aid for such infants is the incubator. The primary objective of the incubator is to provide an environment which will maintain the neonate at a minimum metabolic state thereby permitting as rapid physiological development as possible. Neonatal incubators create a microenvironment that is thermally neutral where a neonate can develop. These incubators typically include a humidifier and a heater and associated control system that controls the humidity and temperature in the neonatal microenvironment. The humidifier comprises a device that evaporates an evaporant, such as distilled water, to increase relative humidity of air within the neonatal microenvironment. The humidifier is typically controllable such that the amount of water, or water vapor, added to the microenvironment is adjustable in order to control the humidity to a desired value. The heater may be, for example, an air heater controllable to maintain the microenvironment area to a certain temperature. Radiant warmers may be used instead of incubators for some neonates where less environmental control is required. In still other embodiments, hybrid incubator/radiant warming systems may be utilized, various embodiments of which are well known in the art.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a neonatal care system includes a base, a bassinet platform supported on the base, and a neonatal sleep device. The neonatal sleep device includes a frame structure connected to and extending upward from the bassinet platform, wherein the sling is suspended above the bassinet platform and configured to support a neonate. The neonatal care system further includes a heater configured to heat an environment surrounding the neonate supported in the sling.

One embodiment of a neonatal sleep device for a neonatal care system includes a frame structure configured to connect to a bassinet platform of a neonatal care system and a sling configured to support a neonate. The sling is removably attached to the frame structure such that it is suspended above the bassinet platform. The frame structure is collapsible so as to lower the sling and the neonate onto the bassinet to enable performance of medical care on the neonate.

Various other features, objects, and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
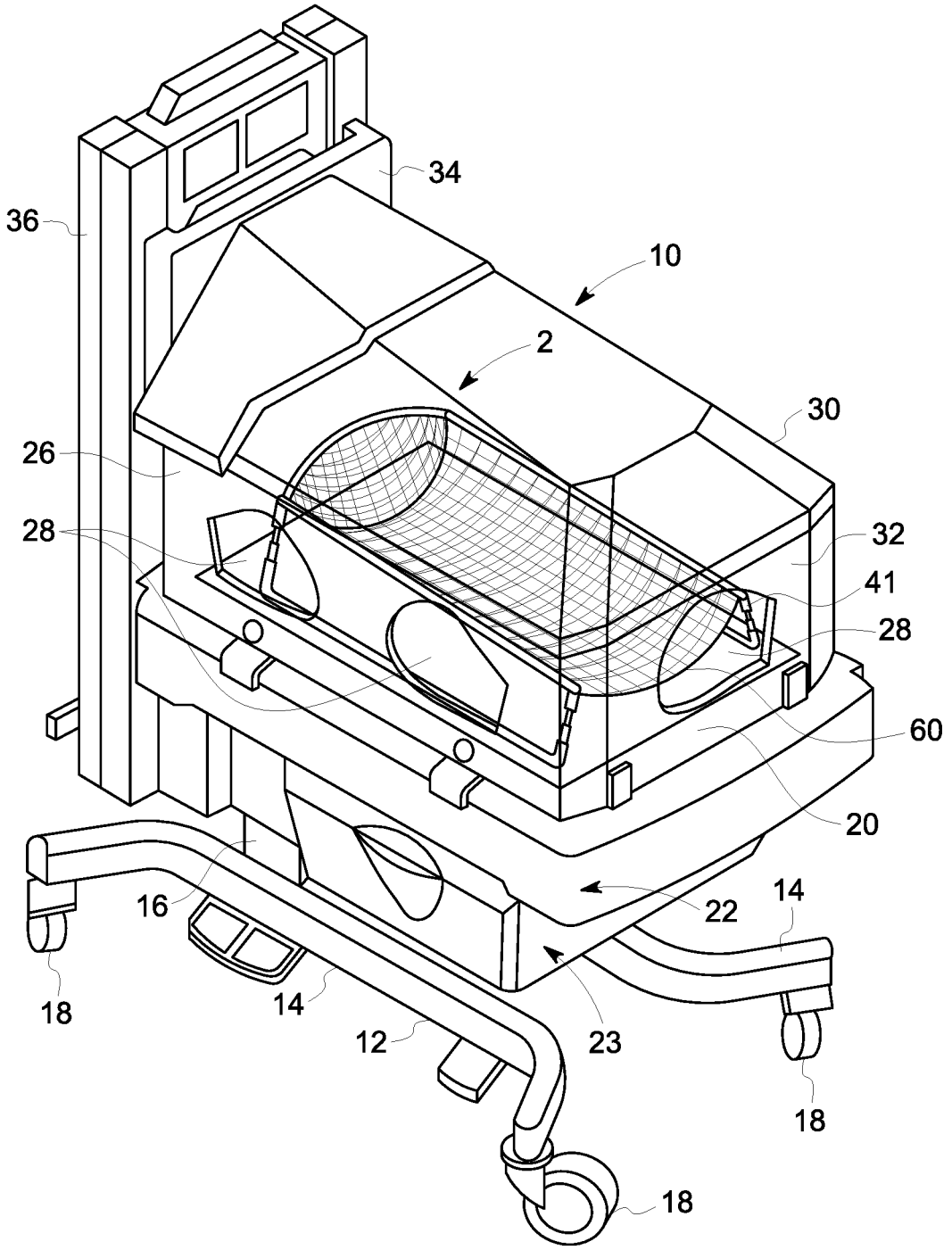
FIG. 1 is a perspective view of an exemplary neonatal care system comprising a sleep device with a sling configured to support a neonate according to one embodiment of the present disclosure.

The inventor has recognized that an improved neonatal sleep device is needed for neonatal care systems—such as incubators, radiant warmers, and other types of neonatal care stations and devices—including an improved pressure diffusing sleep surface that is breathable and allows administration of phototherapy to the neonate's entire body without touching the neonate. The inventor has recognized that existing bassinet mattress surfaces are often either too hard or do not provide sufficient breathability, such as existing foam mattress products and water mattress products available for neonatal care systems. Additionally, the inventor has recognized problems with existing bassinet platforms in neonatal care systems where misuse occurs too easily, such as placing babies on unclean or not adequately prepared mattress surfaces, and that systems should be developed to prevent such misuse cases. For example, a mattress may be installed incorrectly or an incorrect mattress used in an incubator. Another misuse occurs where neonates are placed directly on a mattress without any sheet, or where an unclean or wrong sheet is placed on the mattress.

Through significant research and experimentation, the inventor developed the disclosed neonatal sleep device for a neonatal care system which provides improved pressure diffusion for supporting the neonate, while also providing a breathable sleep surface that permits air to circulate around the neonate. The disclosed neonatal sleep device includes a frame structure that connects to a bassinet of a neonatal care system, such as within a microenvironment of an incubator or under a radiant heater of a radiant warmer. A sling sleep surface is attached to the frame structure and configured to support a neonate such that the neonate is suspended above the bassinet platform. In certain embodiments, the sling sleep surface is formed of one or more materials that permit delivery of phototherapy. Namely, the sling is configured to permit blue light rays emitted by a phototherapy device, such as a blue LED phototherapy unit, to penetrate the sleep surface and reach the neonate's skin. The sling may be comprised of a netting material, for example, that is sufficiently stretchy to provide a comfortable and pressure diffusing sleeping surface, and also to absorb shock due to motion of the neonatal care system, thereby providing a smoother and more comfortable ride for the neonate during transport. The sling sleep surface provides the neonate a natural and relaxed sleep position, providing even pressure disbursement and minimizing the pressure points. The neonatal sleep device may also be adjustable so as to adjust the tilt angle of the sleep surface for the neonate.

In certain embodiments, the neonatal sleep device is collapsible so as to lower the sling and the neonate onto the bassinet platform to enable performance of medical care on the neonate. Namely, the pressure absorbing and/or bouncy sling may not be ideal for supporting a neonate during many medical procedures or examinations. And thus the neonatal sleep device may be configured to allow the neonate to be lowered onto the firmer bassinette platform for performance of such medical care.

FIG. 1 depicts one embodiment of a neonatal care system 10 incorporating one embodiment of a neonatal sleep device 2. In the depicted embodiment, the neonatal care system 10 is an incubator; however, it should be appreciated that other types of neonatal care systems 10 may incorporate the neonatal sleep device 2, including radiant warmer systems, hybrid incubator/warmer systems, and standard bassinets for neonatal care environments without warming or environmental control systems. The depicted incubator neonatal care system 10 includes a base 12 comprising a pair of u-shaped horizontal members 14 joined together and providing support for a vertical base member 16. Wheels 18 may provide for ready movement of the neonatal care system 10. A bassinet platform 20 is supported on the vertical base member 16 of the base 12. In certain embodiments, the bassinet platform 20 may be a standard platform for supporting a neonate, such as configured to receive a removable mattress or other sleep surface in addition to the disclosed neonatal sleep device 2.

The neonatal sleep device 2 includes a frame structure 41 and a sling sleep surface 60 supported on the frame structure 41. The frame structure 41 connects to the bassinette platform 20 and extends upward therefrom. The frame structure 41 may be configured to removably connect to the bassinet platform 20. The sling 60 may be configured to removably attach and detach from the frame structure 41 such that, when attached, the sling 60 is suspended above the bassinette platform 20. The sling 60 may be a reusable element, such as comprised of washable material. In other embodiments, the sling 60 may be a single-use device that is disposable and configured for use with only a single neonate. In either embodiment, the sling 60 is configured to be removed from the frame structure 41 after each use with a neonate. Thus, the above-described misuse cases are prevented because the neonatal sleep device 2 requires placement of a clean and/or new sling sleep surface 60 prior to use. Moreover, the sling 60 may be shaped and configured such that it cannot be improperly attached to the frame 41, thereby preventing the misuse case of placing a neonate on an unclean or improperly configured sleep surface.

A hood 30 may enclose a chamber above the platform 20 to form a microenvironment 32 wherein temperature and humidity are controlled according to the needs of the neonate. The hood 30, when positioned and attached above the bassinet platform 20 includes a plurality of walls 26, normally of a transparent plastic material, which surround and enclose the neonate in the microenvironment 32. The walls 26 may have hand holes 28 to enable a caregiver to reach the neonate. Alternatively or additionally, at least one of the sidewalls 26 may be removable or hinged to open to provide better access to the neonate. Alternatively, a top portion of the hood 30 may be removable to provide complete access to the neonate. In still other embodiments, the hood 30 may be entirely removable from the platform 20. The hood 30 may be configured to abut the vertical frame members 36 such that the hood encloses three sides and the top of the microenvironment 32 and the vertical frame member 36 encloses the fourth side to maintain the microenvironment 32. In other embodiments, the hood 30 may define the entire enclosure above the bassinet platform 20.

The neonatal care system 10 may be configured such that the bassinet platform 20 can be raised and lowered, such as by having an extendible vertical base member 16 that is movable to adjust the height of the bassinet platform 20. The bassinet platform 20 may be mounted in a cantilevered manner such that various systems and devices can be mounted underneath. For example, a heater 22 may be mounted beneath or incorporated below the platform 20 and vents may be provided to circulate heated air into the microenvironment 32 defined by the hood 30. Similarly, a humidifier 23 may be incorporated below the platform 20 and controllable to evaporate water stored in a reservoir in order to control the humidity of the microenvironment 32. The heater 22 and humidifier 23 are controllable, such as by a control unit integrated into the system 10, in order to control the humidity and temperature of the microenvironment 32.

Figure 2:
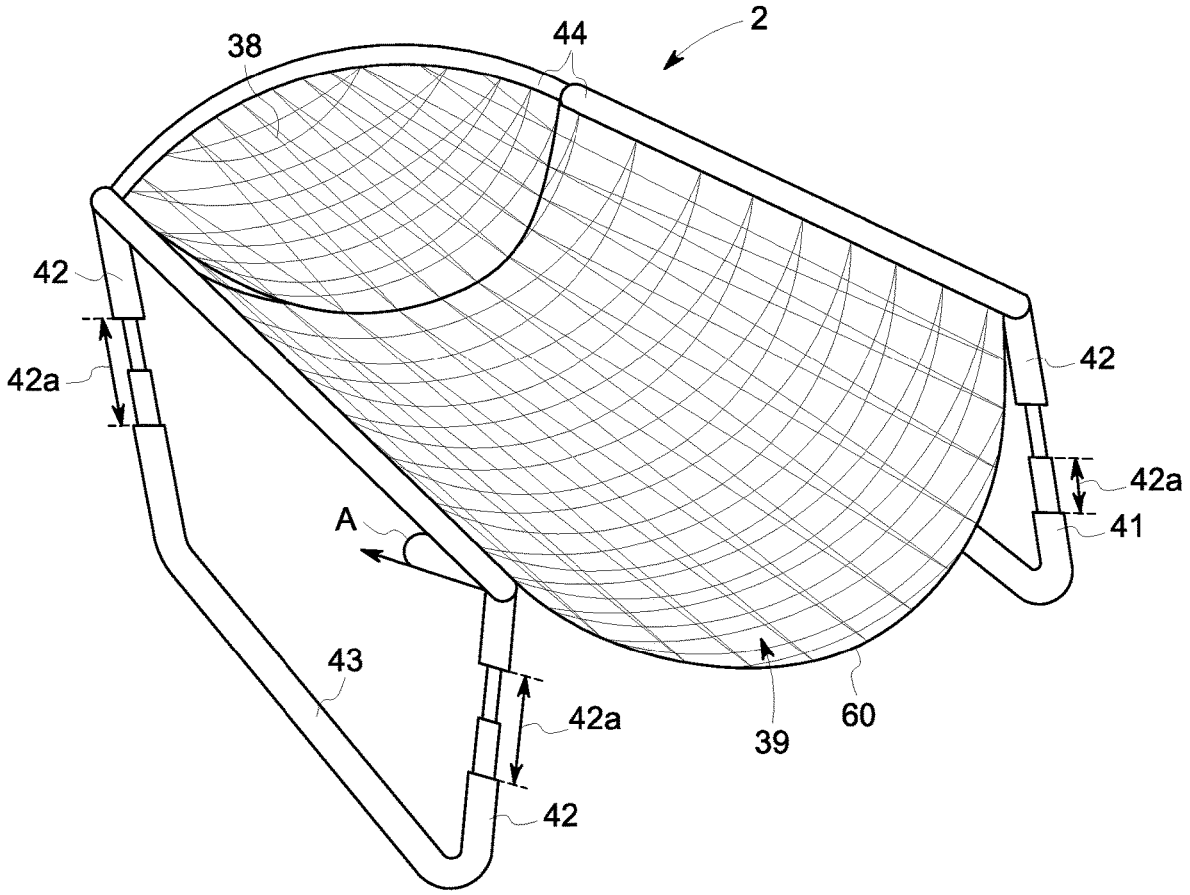
FIG. 2 is one embodiment of a neonatal sleep device for incorporation in a neonatal care system, such as an incubator or radiant warmer.

In the exemplary embodiment depicted in FIGS. 1 and 2, the neonatal sleep device 2 has a frame 41 comprised of vertical support members 42, horizontal support members 43, and at least one top support member 44. The horizontal support members 43 may connect to the bassinet platform 20, such as via any of the various connection means described herein. For example, the horizontal support members 43 may have clips, locking members, or other connectors that removably attach at connection points, or connection elements, on the bassinet platform 20. In other embodiments, the frame structure 41 may be permanently connected to the bassinet platform 20. In such an embodiment, the horizontal support member 43 may be permanently connected and/or integrated with the bassinet platform 20. In other embodiments, the vertical support members 42 may extend directly from the bassinet platform 20 and the horizontal support member 43 may be eliminated.

The top support member 44 is configured to attach to and detach from the sling 60, which is preferably removable from the frame structure 41. Various attachment means for attaching the frame and sling 60 are described herein. In one embodiment, the top support member 44 may be a straight bar on either side of the sling 60 connecting between the vertical support members 42 on the respective side. In other embodiments, the top support member 44 may be a continuous u-shaped rod, wherein the sling 60 is shaped to form over or otherwise connect to the top support member 44.

The vertical support members 42 may be extendible and retractable to raise and lower the height of the sling 60 above the platform 20. In certain embodiments, all four vertical support members 42 are vertically extendible, such as each having a telescoping portion **42*a* that can be extended or collapsed to raise and lower the sling. In other embodiments, only two out of the four vertical support members 42 may be vertically extendible so as to adjust the tilt angle A of the sleeping surface provided by the sling 60 with respect to horizontal. For example, the vertical support members 42 near the head-side of the neonate may be extendible upward so as to raise the head portion of the sling 60 to increase the angle A from horizontal. In other embodiments, the vertical support members 42 on the bottom side of the neonate may be collapsible in order to lower the foot portion 39 of the sling 60. In either embodiment, the angle A of the sleep surface provided by the sling 60** may be adjustable to positive or negative angles (e.g. a Trendelenburg position).

In certain embodiments, frame structure 41 may be collapsible to allow the sling 60 supporting the neonate to lower all the way to the bassinet platform 20. This may be desirable to enable performance of medical care on the neonate where the stretchable sling 60 may not provide an ideal surface for supporting the neonate. For example, the vertical support members 42 may be configured to be shortened sufficiently to lower the sling 60 such that the entire weight of the neonate is supported on the platform 20. In such an embodiment, the telescoping portions 42*a* of the vertical support members may be configured to allow the vertical support members 42 to become small enough such that the sling 60 contacts the bassinet platform 20 and the bassinet platform 20 supports the weight of the neonate. In other embodiments, the bassinet platform 20, or a portion thereof, may be configured to be raisable so as to support the neonate to enable performance of certain medical care for which the sling sleep surface 60 is not ideal.

Figure 3A:
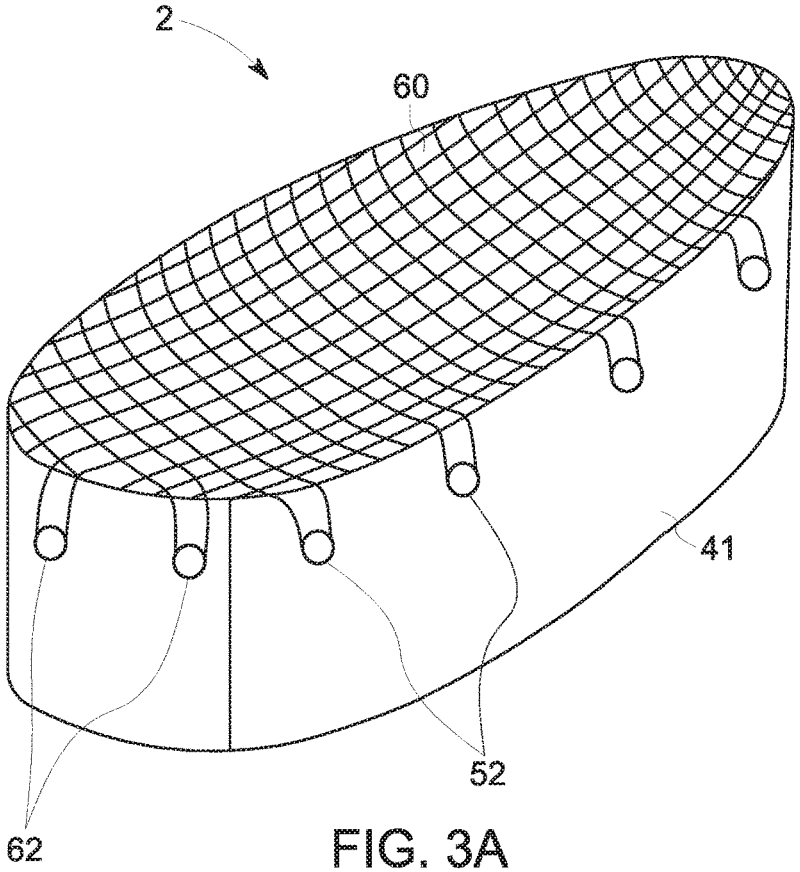
FIGS. 3A and 3B depict a neonatal sleep device according to another embodiment of the present disclosure.
Figure 3B:
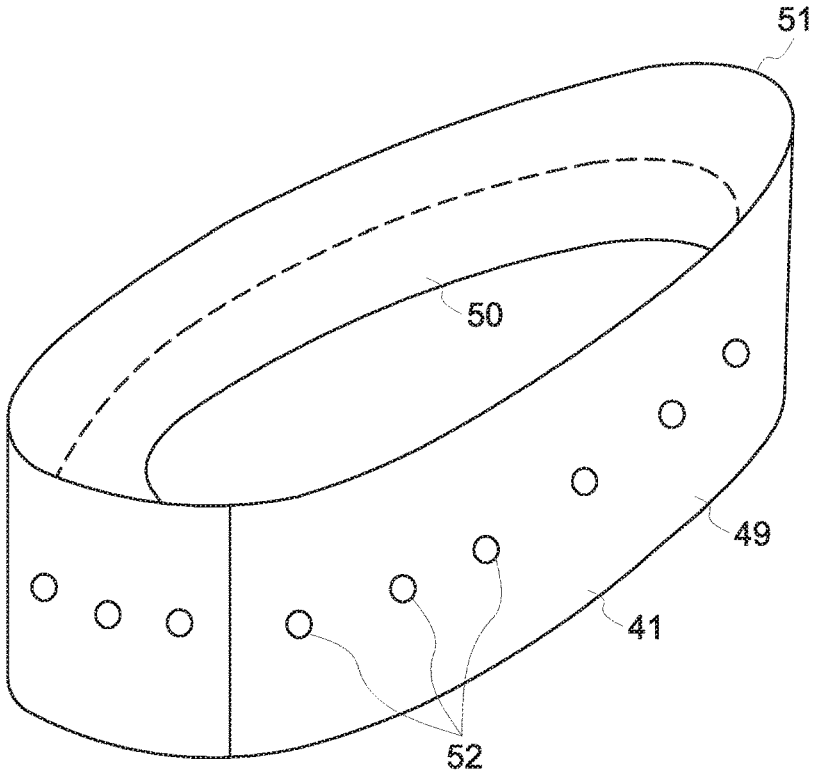

In other embodiments, the frame 41 may be fixed such that the height of the frame is not adjustable. FIGS. 3A and 3B depict one such embodiment, where the frame 41 is a continuous support structure surrounding the sling 60. In the example, the frame 41 includes a vertical exterior side 49 and a ramped interior side 50, which join at a top lip 51. The sling 60 stretches over the top lip 51 and attaches to points on the exterior side 49 of the frame 41. In other embodiments, the exterior side 49 may be ramped and the interior side 50 may be vertical. In still other embodiments, both the interior and exterior sides may be vertical, or both may be ramped. The frame 41 may be sized and shaped to pair with the bassinet platform 20, such as to fit snugly within a groove or tray of the platform. To provide one example, the groove or tray may be alternatively used for containing a mattress when not in use with the neonatal sleep device 2.

Various attachment means may fixedly secure the frame structure 41 to the platform 20. In certain embodiments, the frame 41 and/or the bassinet platform 20 may comprise corresponding elements configured to mateably connect, such as clips, pins, and holes, hooks, locks, or other fasteners that secure the frame 41 to the bassinet platform 20. Still other friction-fit attachment means may connect the frame structure 41 and the bassinette platform 20 (see FIG. 6 and description below). In other embodiments, the neonatal sleep device 2 is not removable and is permanently fixed to the bassinet platform 20. For example, the frame 41 may comprise a continuous piece with a portion of the bassinet platform 20.

The frame structure 41 and sling 60 may attach together by various means. In the example, the sling 60 attaches at various attachment points around the frame 41. The frame 41 comprises sling attachment means 52 for attaching to the sling 60. The sling comprises corresponding frame attachment means 62 for attaching to the frame 41. For example, the sling attachment means 52 may be hooks or buttons, and the frame attachment means 62 may be loops or strips with eyelets configured to attach to the sling attachment means 52. To provide just one example, the sling 60 may comprise a mesh layer comprised of a netting material 66 (see FIG. 9), and the mesh layer may be configured to loop over the sling attachment means 52, thereby providing the frame attachment means 62. The mesh layer of the sling 60 connected to the sling attachment means 52 is thereby configured to support the weight of the neonate. For example, the frame attachment means 62 on the sling 60 may be snaps, clips, pins, hooks, holes, or other elements that mate with corresponding sling attachment means 52 so as to fasten the sling 60 on the frame 41. Still other friction-fit frame attachment means 62 and sling attachment means 52 may be provided, such as where the top support member 44 or the top lip 51 of the frame structure 41 comprises a clamp that clamps over the sling 60 so as to provide connection between the frame structure 41 and the sling 60.

Figure 4A:
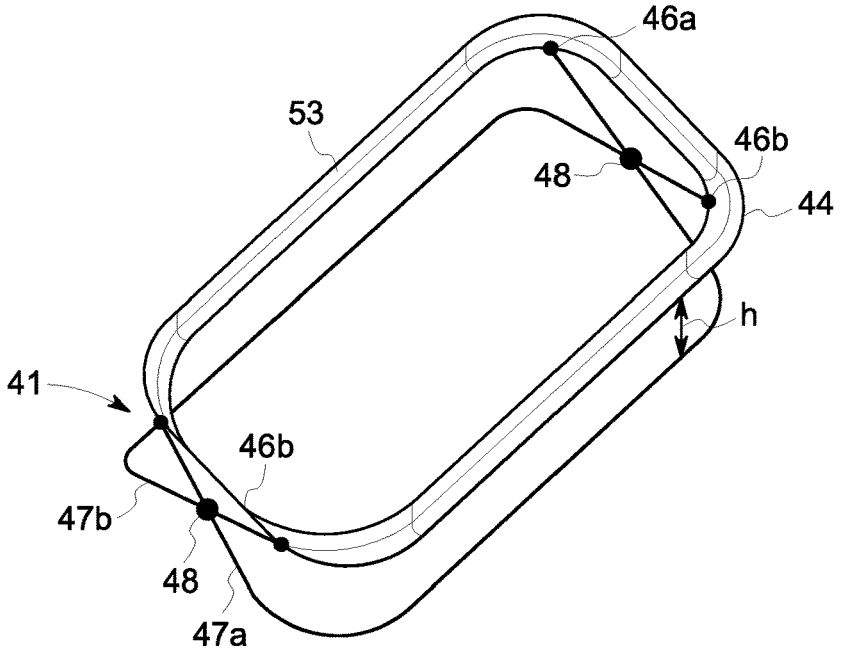
FIGS. 4A-4C depict a neonatal sleep device according to another embodiment of the present disclosure.
Figure 4B:
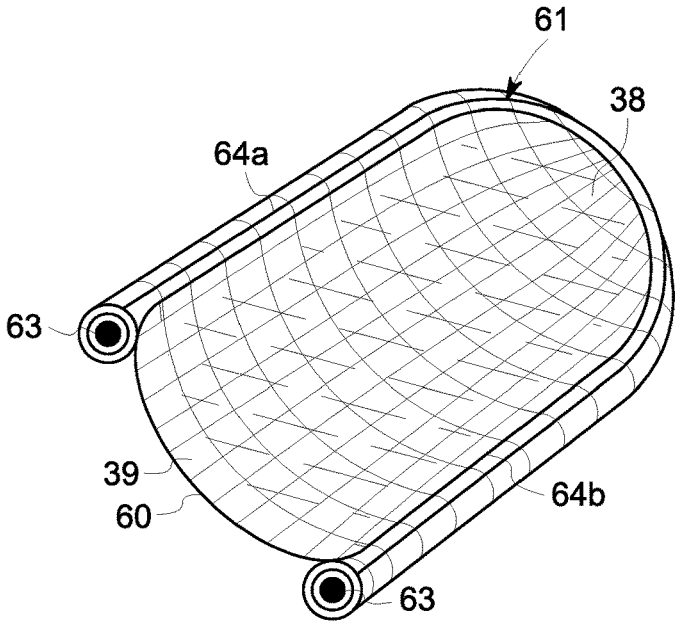
Figure 4C:
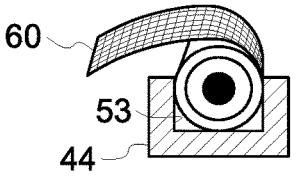

FIGS. 4A through 4C depict another embodiment of the neonatal sleep device 2 where the frame 41 has a connection means provided on the top support member 44. Referring to FIGS. 4A and 4C, the top support member 44 includes a groove 53 configured to receive a sling frame member 63. In the example, the sling frame member 63 is a rod sized to fit within the groove 53 on the top support member 44 of the frame structure 41. FIG. 4C is a cross-sectional view of the connection. The sling frame member 63 connects to the material of the sling 60. As illustrated in FIG. 4B, the material of the sling 60 may wrap around the sling frame member 63, which in this example is a rod, and the wrapped sling frame member 63 fits within the groove 53 of the top support member 44. Thereby, the sling 60 is maintained in place by the tight connection between the sling frame member 63 and the groove 53. In one embodiment, the sling 60 is a separate material piece from the sling frame member 63, where the sling frame member slides in and out of a channel sewn or otherwise formed along the outer edge 61 of three sides of the sling 60. Thereby, the sling is configured to mate with the top support member 44 along three sides of the sling 60. In other embodiments, only two lateral sides of the sling 60 may only attach to the top support member 44 along the two lateral sides 64*a*, 64*b*. In such an embodiment, the sling frame member 63 may comprise two lateral side portions, such as two rods, that connect in corresponding grooves on the lateral sides of the top support member 44.

Figure 5A:
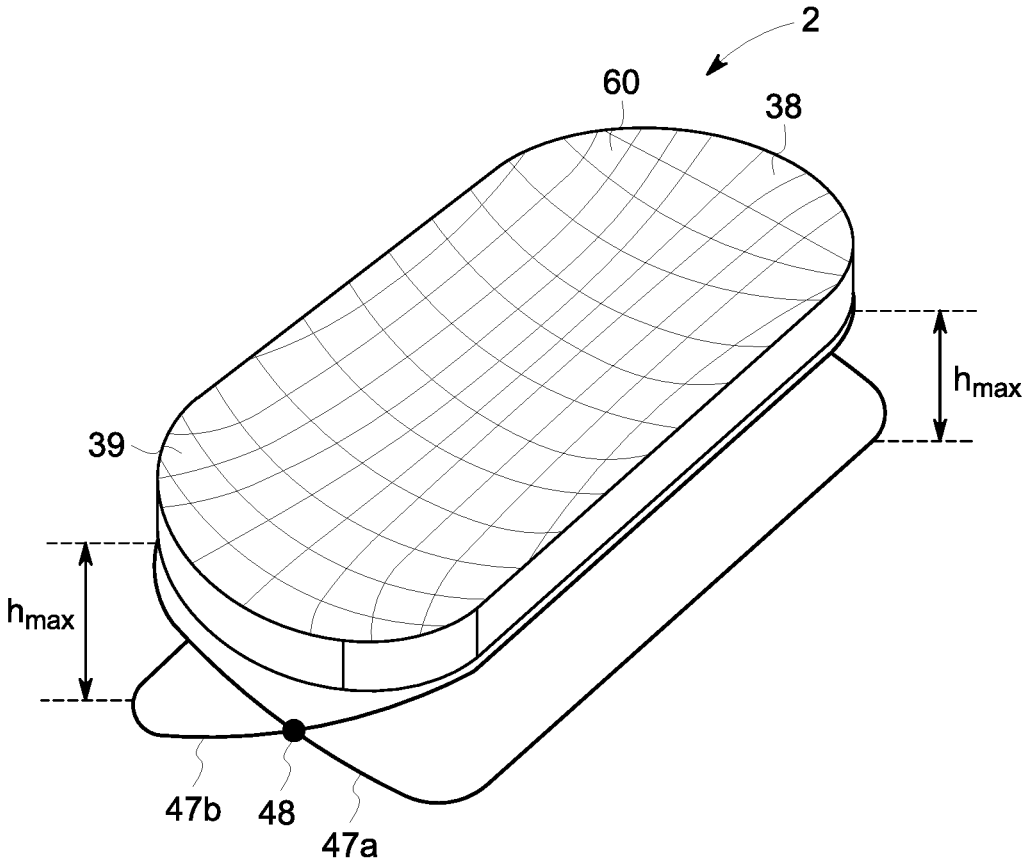
FIGS. 5A-5C depict a neonatal sleep device according to still another embodiment of the present disclosure.
Figure 5B:
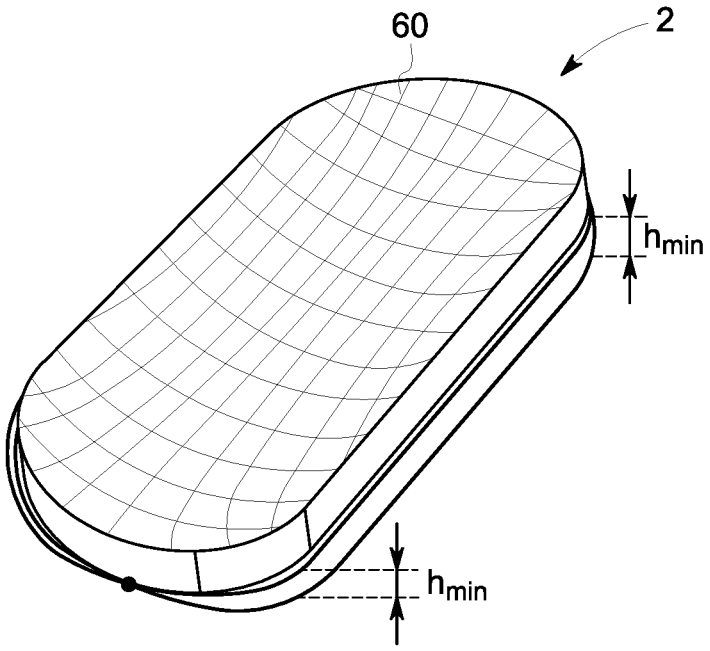
Figure 5C:
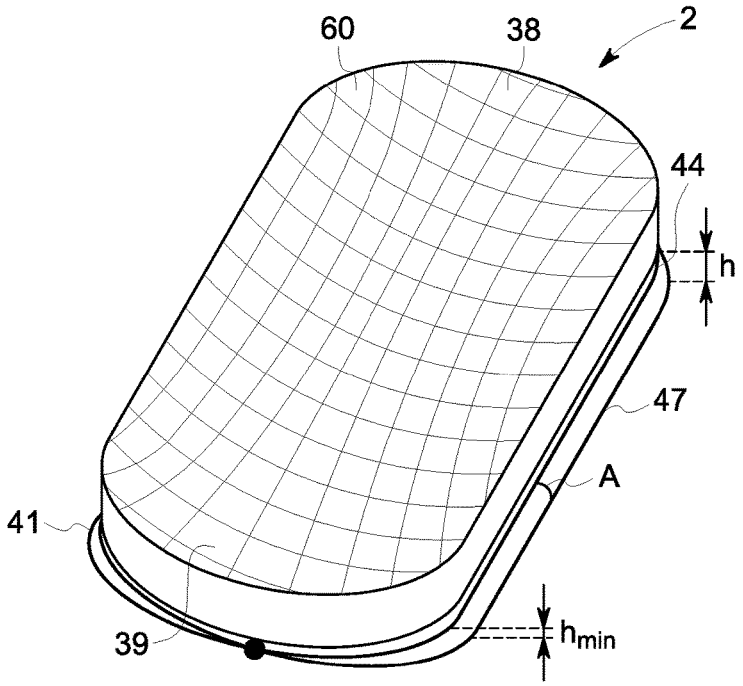

FIGS. 4A and 5A-5C depict an embodiment of a collapsible frame structure 41 comprising a top support member 44 supported on two diagonal-crossing support members 47*a* and 47*b* that are connected at a movable joint 48 such that the frame 41 can be raised and lowered. The support members 47*a* and 47*b* connect to the top support member 44 at a respective top joint 46*a*, 46*b* as shown in FIG. 4A. In one embodiment, the movable joint 48 may be configured to maintain and control the relative position of the support members 47*a* and 47*b* so as to control the height h of one or both end portions 38, 39 of the sling 60. FIGS. 5A-5C exemplify various heights and tilt angles that may be achieved with the collapsible frame structure 41. In FIG. 5A, the supports 47*a* and 47*b* are positioned at a maximum height $h_{max}$. Thereby, the sling 60 is raised to a maximum height above the bassinet platform 20. FIG. 5B depicts the frame 41 fully collapsed, and thus at a minimum height $h_{min}$. Thus, the support members 47 move with respect to one another via the movable joint 48 to raise and collapse so as to raise and lower the sling 60 with respect to the bassinet platform 20. In certain embodiments, the movable joint 48 and the support members 47 may be configured to be raised to achieve multiple heights between the minimum $h_{min}$ and the maximum $h_{max}$.

In certain embodiments, the frame 41 may be configured such that the ends may be positioned at different heights so as to control a tilt angle of the sleeping surface for the neonate. FIG. 5C provides one example where the foot portion 39, or the end of the sling 60 adjacent to the feet of the neonate, is at a lower height than the head portion 38 of the sling 60. In the example at FIG. 5C, the foot portion 39 is at a minimum height $h_{min}$, such that the movable joint 48 and support members 47 are fully collapsed on the foot side of the frame 41. The head portion 38 is raised to height h so as to provide tilt angle A for supporting the sling 60 and a tilted sleeping surface for the neonate. The head portion 38 may be raised and lowered to increase and decrease the tilt angle A, such as by adjusting the movable joint 48 and support members 47*a* and 47*b* on the side of the head portion 38, to provide an adjustable sleep angle for the neonate. Likewise, the tilt angle A can be adjusted by adjusting the height at the foot portion 39.

Figure 6:
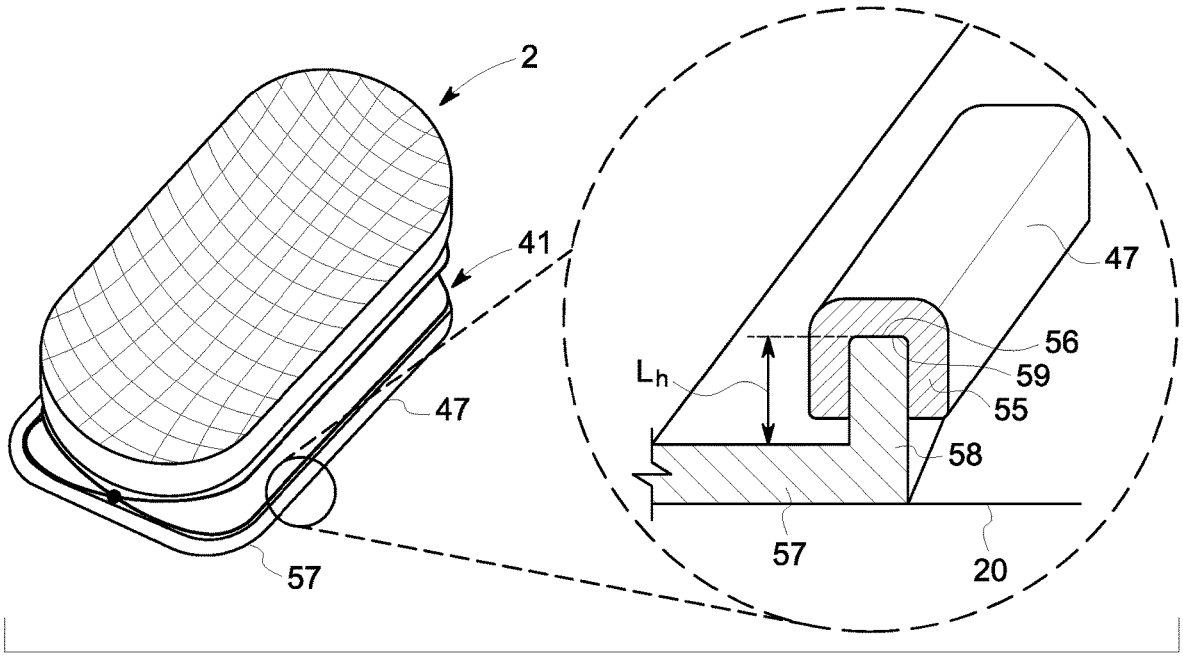
FIG. 6 depicts a neonatal sleep device according to another embodiment of the present disclosure that includes a tray for connecting to a neonatal care system.

FIG. 6 depicts one way that the neonatal sleep device 2 may be configured to removably connect to the bassinet platform 20. In one embodiment, a bottom portion of the frame structure 41 may comprise clips configured to clip to a corresponding portion of the platform 20 or some element provided on the platform 20. In the example, the bottom portion of the support members 47 form a clip 55 having a groove configured to provide a pressure fit over a lip 58 extending above the bassinet platform 20. For example, the clip 55 may include a deformable material inside the groove, such as rubber or softer plastic, so as to provide a friction fit over the lip 58. Thereby, the neonatal sleep device 2 can be securely connected to the bassinet platform 20. For example, the lip may extend from a tray 57, which may comprise part of the bassinet platform. The tray 57 may be formed to also contain a bassinet mattress, which may be an alternative to or used in conjunction with the neonatal sleep device 2. Alternatively, the tray 57 may be separable from the remainder of the bassinet platform 20, such as when the neonatal care system 10 is in use without the neonatal sleep device 2. Accordingly, the tray 57 may provide part of the connection means for removably connecting the frame structure 41 to the bassinet platform 20.

Figure 8:
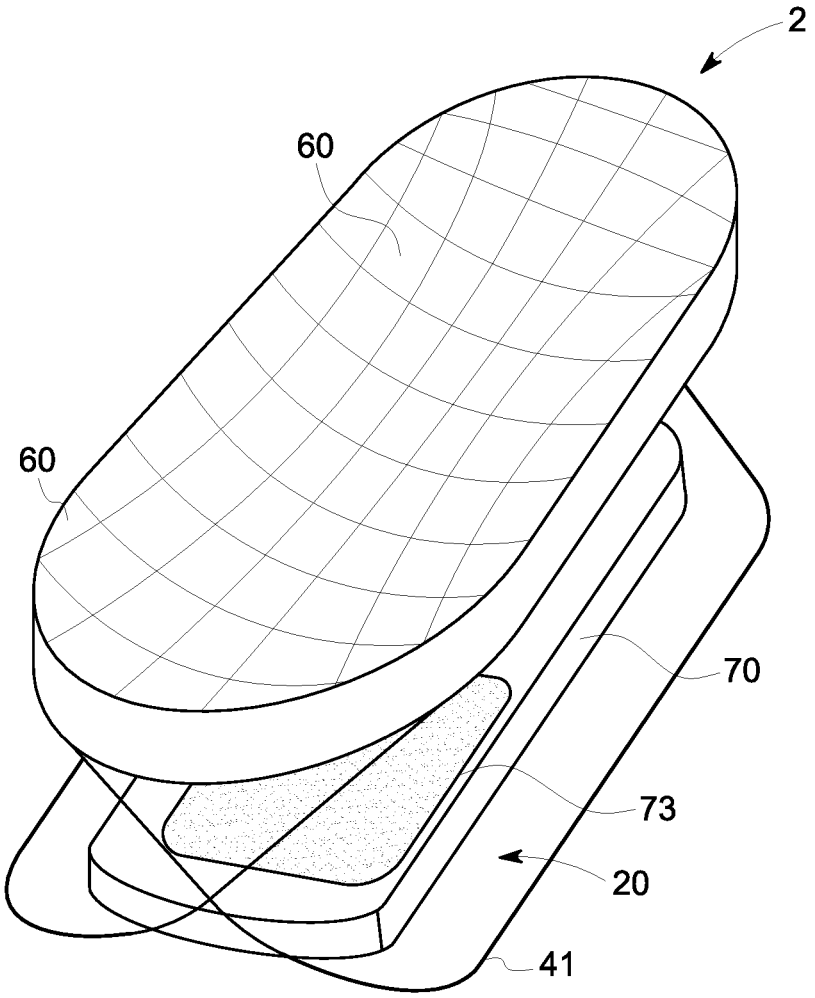
FIG. 8 depicts one embodiment of a neonatal sleep device having a raisable portion of the bassinet platform according to one embodiment of the disclosure, and also including a phototherapy device on the bassinet platform and under the neonatal sleep device according to another embodiment of the present disclosure.
Figure 9:
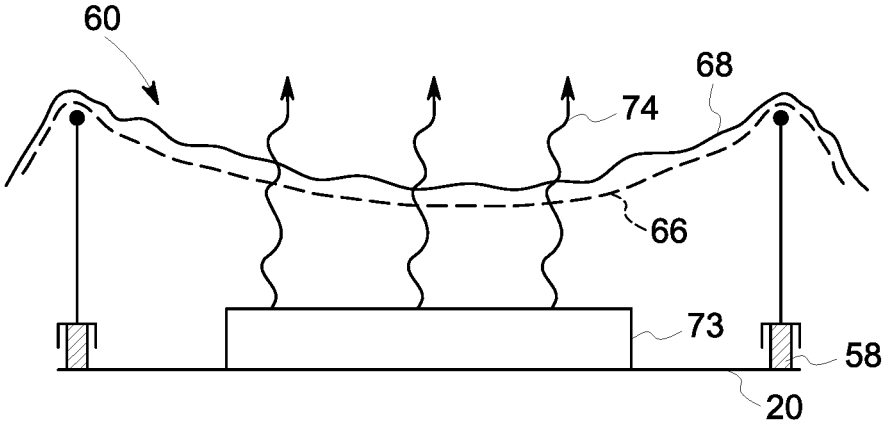
FIG. 9 depicts a cross-sectional view of a neonatal sleep device according to one embodiment of the disclosure.

In other embodiments, the lip 58 may extend and be integrated into the bassinet platform 20, rather than have a tray 57. FIG. 9 exemplifies such an embodiment, where the lip 58 extends from an integral part of the bassinet platform 20. Other fastening mechanisms, or clips, may be provided for connecting the frame 41 to the bassinet platform, such as locking mechanism, hooking devices, etc. The lip 58 has a height $L_h$, which may extend above the inside of the tray 57 above the bassinet platform 20. The clip 55 is configured such that an interior top side 56 of the clip 55 meets the top 59 of the lip 58. Thereby, the frame structure 41 can be steadily and securely supported on the bassinet platform 20. FIG. 8 depicts an embodiment where the bassinet platform 20 further comprises a raised platform portion 70. In certain embodiments, the raised platform portion 70 may be a fixed and permanent part of the bassinet platform 20, or may be removably attachable. The raised platform portion 70 may be configured to receive and support the neonate when the frame structure 41 is fully collapsed, so as to enable performance of medical care on the neonate by providing a steady support surface. In other embodiments, the raised platform portion 70 may be configured to be raised and lowered, so as to enable bringing the platform surface upward to contact the sling 60. Thus, the bassinet platform 20 (or a portion or section thereof) may be raised, rather than the frame structure 41 collapsing, in order to support the neonate on a flat and sufficiently stable surface to enable performance of medical care.

FIGS. 7A-7D depict another exemplary embodiment of the neonatal sleep device 2 where the frame 41 is comprised of a curved support member 45 moveable with respect to a connector 65 that provides connection to the bassinet platform 20. In the depicted embodiment, the frame 41 has a curved support member 45 connecting to and supporting a top support member 44 that, in turn, connects to and supports the sling 60 (such as via the grooves on the lateral side as shown above). The curved support member 45 is arched to support the sling 60 at a vertical height above the platform 20, and the curved support member 45 may be configured of a material that permits flex so as to provide additional shock absorption.

The curved support member 45 may be reciprocally designed with the bassinet connector 65 such that the curved support member 45 is moveable with respect to the bassinet connector 65 in order to adjust the tilt angle A for supporting the sling 60 and providing an angled sleeping surface for the neonate. In the depicted embodiment, the curved support member 45 is moveable in the fore and aft directions indicated by arrow 69*a*. The connector 65 may also be moveable with respect to the bassinet platform 20, as exemplified by arrow 69*b*, so as to compensate for at least a portion of the directional movement of the curved support member 45. Namely, the connector 65 may move in an opposite direction from the curved support member 45, thus a change in the relative position of the sling 60 with respect to the head-side or foot-side of the microenvironment can be minimized.

Figure 7A:
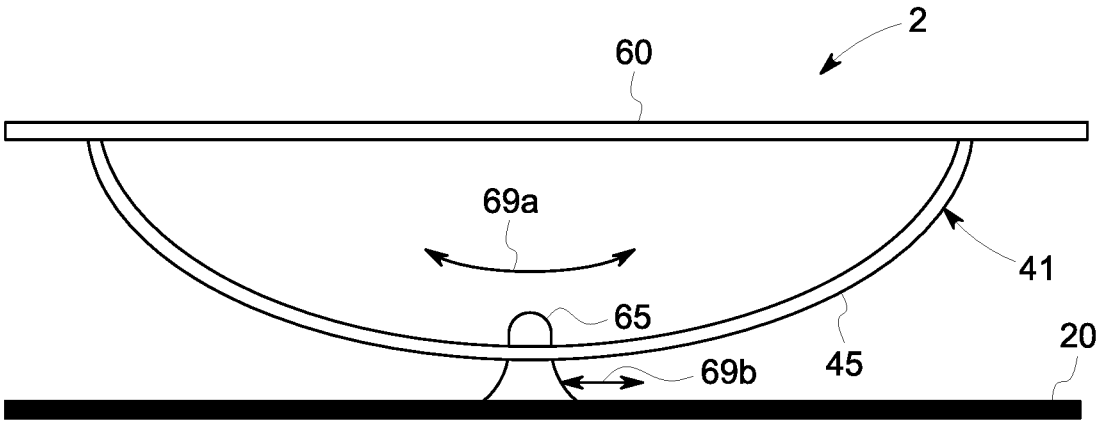
FIGS. 7A-7D depict a neonatal sleep device according to another embodiment of the present disclosure.
Figure 7B:
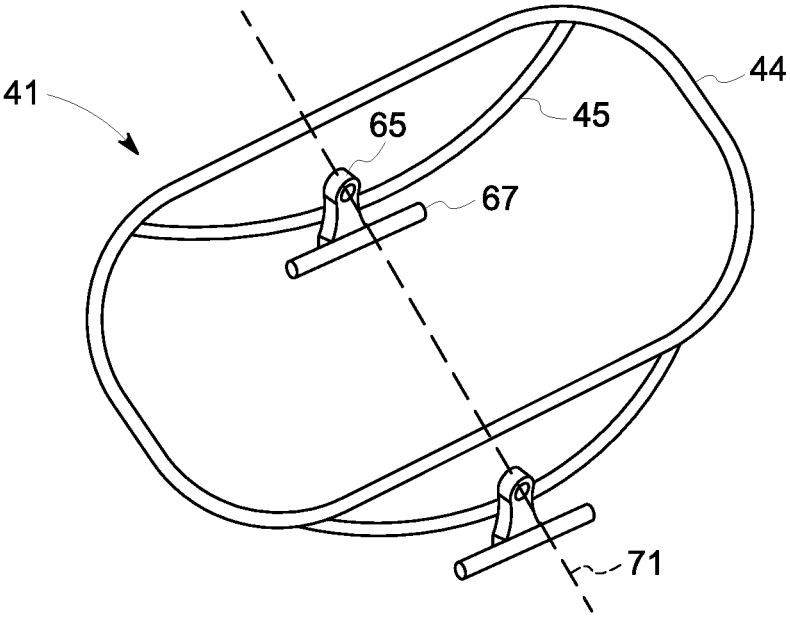
Figure 7C:
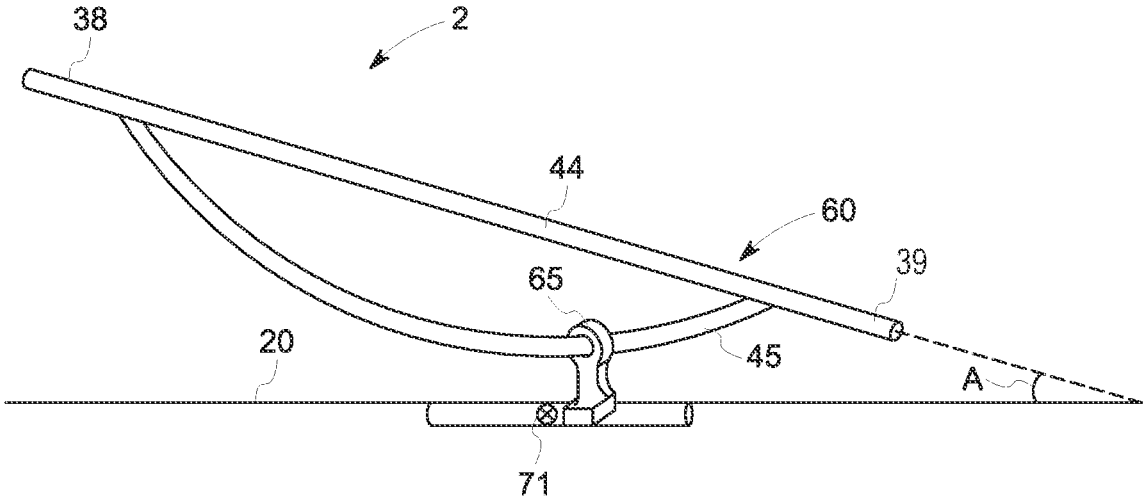
Figure 7D:
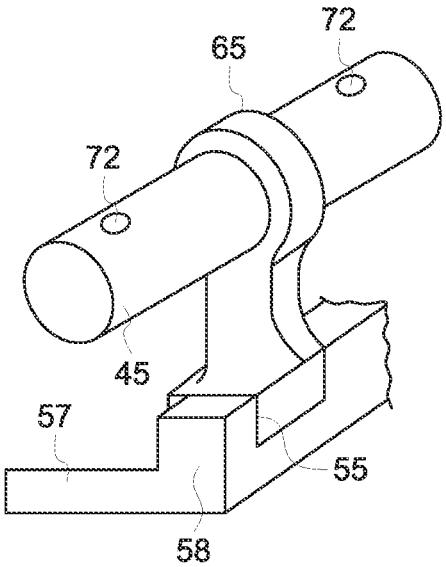

FIGS. 7A and 7B depict the frame 41 in a centered position, where the sleep surface is horizontal and parallel with the bassinet platform 20. The connector 65 is in a centered position along a centered horizontal line 71. FIG. 7C depicts a tilted position, where the head portion 38 of the sling 60 is raised and a foot portion 39 is lowered so as to position the frame 44 supporting the sling 60 at angle A. The connector 65 is moved away from the center line 71 toward the foot-side, which compensates for at least some of the movement of the sleep surface toward the head-side of the neonatal care system 10. In certain embodiments, the connector 65 may connect to a slideable track 67 or other adjustable device integrated into or otherwise securely connected to the bassinet platform 20. In other embodiments, the neonatal sleep system 2 may comprise a tray 57 as shown in FIG. 7D and described above with respect to FIG. 6. For example, the connector 65 may comprise a clip 55 that connects to a lip 58 of the tray 57. In such an embodiment, the connector 65 may be moved lengthwise along the lip 58 in order to position the sleep device 2 appropriately within the neonatal care system 10.

In the depicted embodiment, the curved support member 45 is moveable with respect to the connector 65 and is lockable at certain predefined positions so as to change the tilt angle A of the neonatal sleep system 2. In the depicted embodiment at FIG. 7D, the curved support member 45 has holes 72 that receive a spring-loaded locking pin or other portion in the connector 65 that inserts into the holes 72 in order to lock the curved support member 45 in place. In other embodiments, the connector 65 and curved support member 45 may have other connecting means, which may provide continuous connection along any part of the curved support member 45 or connection at particular locations (such as at the locations of the holes 72 in the depicted example).

In certain embodiments, a phototherapy device 73 may be placed underneath the sling 60 so as to provide phototherapy to the neonate. In such an embodiment, the sling 60 is comprised of a material that permits delivery of phototherapy therethrough—i.e. that is penetrable by blue wavelength light emitted by the phototherapy device 73. FIG. 9 depicts an example where the phototherapy device 73 is positioned beneath the sling 60, and wherein the blue light 74 emitted by the phototherapy device 73 penetrate through the sling 60 so as to reach the neonate. Thereby, phototherapy can be provided to all (above and below the patient) sides of the neonate without touching the neonate or otherwise changing the neonate's position. Thus, as will be understood by a person having ordinary skill in the art in view of this disclosure, two or more light-emitting phototherapy devices may be positioned in the neonatal care environment so as to direct light toward the neonate from multiple directions, such as opposing directions. The sling 60 may be any material appropriate for supporting a neonate. In one embodiment, the sling 60 may be comprised of two layers, including a netting material 66 and a sheet top layer 68. The netting material may be a pressure-diffusing material. Netting material may be comprised of various non-latex materials having stretching and contracting properties, such as polypropylene, polyethylene, nylon, PVC or PTFE, or a similar synthetic, man-made polymer such as polyethylene terephthalate. It could be elastomeric fabric, such as a synthetic fabric providing either 2-way stretch or 4-way stretch, crosswise and/or lengthwise. The net pattern may vary, and may be, for example, from 50% to 90% open.

The netting material 66 may be covered by a sheet top layer 68, which is any material appropriate for contacting the skin of the neonate. The sheet 68 material may be constructed from materials that are partially translucent for light wavelengths of peak phototherapy device operation, such as for wavelengths in the range of 445 nm-470 nm. The assembled sleep surface comprised of netting material 66 and sheet 68 preferably provides low frequency vibration damping. In one exemplary embodiment, the maximum peak pressure measured by placing 680 g (1.5 lbs.) on the sling sleep surface does not exceed 28 mmHG and is capable of supporting up to 5 kg (11 lbs.) distributed weight on the sleep surface netting area while keeping it elevated at least 5 mm (0.2 inches) above the microenvironment platform 20. The sling 60, including the sheet and netting assembly, preferably meets X-ray image clarity requirements and will produce no artifacts in the X-ray image that make the X-ray difficult to read as evaluated by a radiologist. The netting material 66 and sheet 68 are preferably constructed from non-toxic, DEHP and BPA free, materials and not from materials known as potentially causing allergic reactions, such as materials having any animal tissues. The netting material 66 and sheet 68 preferably have neutral or low odor. The sheet 68 is preferably impermeable and not absorbent of any liquids. Preferably, any seams or other material-connecting areas of the netting material 66 and/or sheet 68 shall not come in contact with a neonate when the sling 60 is in use. As exemplified in FIG. 9, the sheet material 68 may be oversized, and configured with sufficient slack such that the weight of the neonate is supported by the pressure-diffusing netting material 66, rather than the sheet top layer 68.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A neonatal care system comprising:

a base;

a bassinette platform supported on the base;

a frame structure connected to a top surface of the bassinette platform and comprising at least one support member extending upward from the bassinette platform and a top support member configured to attach to an outer edge of a sling, wherein the sling is suspended from the top support member above the bassinette platform;

wherein the sling is configured to support a neonate;

a heater configured to heat an environment surrounding the neonate supported in the sling; and wherein the at least one support member includes at least one vertical support member extending upward from the bassinette platform and that is configured to collapse and lower the sling and the neonate onto the bassinette platform to enable performance of medical care on the neonate, or wherein at least a portion of the bassinette platform is configured to be raised with respect to the sling and the neonate such that the sling is no longer suspended and the sling and the neonate are supported atop the at least the raised portion of the bassinette platform to enable performance of medical care on the neonate.

2. The neonatal care system of claim 1, further comprising a hood above the bassinette platform and configured to encapsulate a microenvironment around the neonate, wherein the frame structure and sling are inside the hood such that the neonate supported in the sling is maintained within the microenvironment.

3. The neonatal care system of claim 1, wherein the frame structure is removably connected to the bassinette platform such that the frame structure can be alternately connected to and removed from the bassinette platform.

4. The neonatal care system of claim 3, wherein the frame structure further comprises a clip that secures the frame structure to the bassinette platform.

5. The neonatal care system of claim 1, wherein the frame structure is adjustable in order to adjust a tilt angle of the sling.

6. The neonatal care system of claim 1, further comprising a phototherapy device on the bassinette platform under the sling, and wherein the sling is comprised of a material that permits delivery of phototherapy to the neonate through the sling.

7. The neonatal care system of claim 1, wherein the sling is comprised of a pressure-diffusing netting material.

8. The neonatal care system of claim 7, wherein the sling is further comprised of a sheet top layer on top of the pressure-diffusing netting material.

9. The neonatal care system of claim 8, wherein the sheet top layer of the sling has sufficient slack such that a weight of the neonate is supported by the pressure-diffusing netting material and not the sheet top layer.

10. The neonatal care system of claim 1, wherein the sling is removable from the frame structure and replaceable on the frame structure.

11. The neonatal care system of claim 10, wherein the frame structure comprises sling attachment means for attaching to the sling.

12. The neonatal care system of claim 10, wherein the sling comprises frame attachment means for attaching to the frame structure.

13. The neonatal care system of claim 10, wherein the sling is disposable and configured for use with only a single neonate.

14. The neonatal care system of claim 1, wherein the frame structure includes the vertical support member that is configured to collapse and lower the sling and the neonate onto the bassinette platform.

15. The neonatal care system of claim 14, wherein the collapsible frame structure includes at least two vertical support members having a telescoping portion configured to be extended to raise the sling and the neonate above the bassinette platform and collapsed to lower the sling and the neonate onto the bassinette platform.

16. The neonatal care system of claim 14, wherein the collapsible frame structure includes at least four vertical support members, each having a telescoping portion configured to be extended to raise the sling and the neonate above the bassinette platform and collapsed to lower the sling and the neonate onto the bassinette platform.

17. The neonatal care system of claim 1, wherein the at least the portion of the bassinette platform is configured to be raised with respect to the sling and the neonate such that the sling is no longer suspended and the sling and the neonate are supported atop the at least the raised portion of the bassinette platform.

* * * * *